US009200212B2

(12) United States Patent
Sharma et al.

(10) Patent No.: US 9,200,212 B2
(45) Date of Patent: Dec. 1, 2015

(54) METHOD AND APPARATUS FOR DESULFURIZATION OF HEAVY OIL USING A FERRATE(VI)

(75) Inventors: Virender K. Sharma, Melbourne, FL (US); Abdullah Al-Abduly, Riyadh (SA)

(73) Assignee: Florida Institute of Technology, Melbourne, FL (US)

( * ) Notice: Subject to any disclaimer, the term of this patent is extended or adjusted under 35 U.S.C. 154(b) by 178 days.

(21) Appl. No.: 13/276,613

(22) Filed: Oct. 19, 2011

(65) Prior Publication Data

US 2012/0091040 A1 Apr. 19, 2012

Related U.S. Application Data

(60) Provisional application No. 61/394,461, filed on Oct. 19, 2010.

(51) Int. Cl.

| | |
|---|---|
| ***C10G 29/16*** | (2006.01) |
| ***C10G 53/08*** | (2006.01) |
| ***C10G 53/14*** | (2006.01) |
| ***C10G 25/00*** | (2006.01) |

(52) U.S. Cl.

CPC ..... *C10G 25/00* (2013.01); *C10G 29/16* (2013.01); *C10G 53/08* (2013.01); *C10G 53/14* (2013.01); *C10G 2300/202* (2013.01); *C10G 2300/44* (2013.01)

(58) Field of Classification Search

CPC ..... C10G 2300/202; C10G 2300/44; C10G 25/00; C10G 29/16; C10G 53/08; C10G 53/14

USPC ..... 208/177, 208 R, 219, 220, 244, 249

See application file for complete search history.

(56) References Cited

PUBLICATIONS

Liu, S, et al., Deep Desulfurization of Diesel Oil Oxidized by Fe (VI) Systems, Fuel, vol. 87, 2008, pp. 422-428.*

Lee, Y, et al., Chemistry of Ferrate (Fe(VI)) in Aqueous Solution and its Applications as a Green Chemical, J. Ind. Eng. Chem, vol. 10, No. 1, 2004, pp. 161-171.*

Otsuki, S., et al., Oxidative Desulfuration of Light Gas Oil and Vacuum Gas Oil by Oxidation and Solvent Extraction, Energy & Fuels, vol. 14, 2000, pp. 1232-1239.*

Sigma-Aldrich, MSDS.*

Nanoti, A, et al., Mesoporous Silica as Selective Sorbents for the Removal of Sulfones From an Oxidized Diesel Fuel, 2009, Microporous and Mesoporous Materials, vol. 124, pp. 94-99.*

* cited by examiner

*Primary Examiner* — Derek Mueller

(74) *Attorney, Agent, or Firm* — Christensen O'Connor Johnson Kindness PLLC

(57) ABSTRACT

A method for desulfurization of heavy fuel oil using ferrate compounds by mixing fuel oil containing sulfur compounds with a solvent and forming a fuel oil solvent mixture, dissolving the sulfur compounds present in the fuel oil solvent mixture. Adding a liquid ferrate solution to the fuel oil solvent mixture produces oxidized sulfur compounds, in solution. An absorbing agent is added to remove the oxidized sulfur compounds from said solution.

12 Claims, 3 Drawing Sheets

Polycyclic Aromatic Sulfur Heterocyclic Compounds (PASHs)

Benzothiophene (BT)

Dibenzothiophene (DBT)

4-methyl-DBT (4-MDBT)

3-methyl-BT
(3-MBT)

4,6-dimethyl-DBT
(4,6-DMDBT)

2,4,6-trimethyl-DBT
(2,4,6-TMDBT)

METHOD AND APPARATUS FOR DESULFURIZATION OF HEAVY OIL USING A FERRATE(VI)

A claim for priority is made under 35 U.S.C. 119(e) for provisional patent application No. 61/394,461 filed Oct. 19, 2010

FIELD OF THE INVENTION

This invention is in the field of oxydesulfurization of oil by the use of ferrate.

BACKGROUND OF THE INVENTION

During the past three decades, there have been many efforts to reduce the level of sulfur content of fossil fuels. In the combustion process of an engine, the combustion of sulfur or sulfur containing compounds leads to sulfur dioxide formation. Sulfur dioxide can cause the formation of sulfate aerosol particles. Moreover, sulfur dioxide can form acidic rain causing adverse effects on the environment and artifacts. Fuel combustion processes are thus the main sources of sulfur dioxide emissions. Therefore, the amount of sulfur present in fuels correlates proportionally with the amount of sulfur dioxide emitted. The United States Environmental Protection Agency U.S.E.P.A has established several stringent regulations for sulfur content in road transportation fuels and non-road fossil fuels in order to control the emission of sulfur dioxide from the combustion of fuel.

Sulfur can be found in many different forms in fuel, but organic sulfides, thiophenes, benzothiophenes, and dibenzothiophenes are the major sulfur-containing compounds present in liquid fuels. Importantly, more than 85% of the sulfur-containing compounds in diesel fuel are thiophenes, and above 70% of the thiophenic compounds are benzothiophene (BT) and dibenzothiophene (DBT). Several methods including hydrodesulfurization (HDS), biodesulfurization (BDS), and oxidesulfurization (ODS) have been tested for fuel desulfurization.

The hydrodesulfurization method has limitations such as the usage of high concentration of hydrogen under extreme conditions of pressure and temperature over sulfided Co—Mo/$Al_2O_3$ and Ni—Mo/$Al_2O_3$. Furthermore, it provides low efficiency of removing sulfur from polycyclic aromatic sulfur heterocyclic compounds (PASHs), particularly dibenzothiophene (DBT) and its derivatives such as 4-methyl dibenzothiophene (4-MDBT), and 4,6-dimethyl dibenzothiophene (4,6-DMDBT). Even though the efficiency of the HDS process can be enhanced by increasing the severity of the HDS process conditions, there are undesirable side reactions which become dominant as the severity is increased. For instance, during the hydrodesulfurization of gasoline at high pressure, many olefins are saturated and the octane number decreases. Higher temperature also leads to increased coke formation and subsequent catalyst deactivation. These limitations cause a low effectiveness of the HDS method.

In the BDS method, the desulfurization process is achieved by using biochemical, microbiological, or enzymatic means to conduct the desulfurization. This method is performed under mild conditions and has shown higher selectivity than the HDS method. However, only a few enzymes have demonstrated the capability of removing sulfur atoms from heterocyclic molecules in fuel without causing oxidative loss of carbon.

The ODS method is based on the oxidation of thiophenic compounds to their corresponding oxidized forms FIG. 2. The physical and chemical properties of sulfoxides and sulfones are different from the corresponding non-oxidized forms; therefore they can then be separated easily from the body of fuel by extraction with polar solvents or by adsorption on silica gel. The ODS method has high efficiency of reducing the sulfur content in diesel fuel as well as that of nitrogen compounds under mild operating conditions, with no need of hydrogen gas. Significantly, the ODS process shows high reactivity with aromatic sulfur compounds. The oxidesulfurization method has a high efficiency when it is combined with other separation methods like adsorption or extraction. The combination of oxidation with simultaneous extraction of oxidized aromatic sulfur compounds from a non-polar phase to a more polar phase, was found to improve the oxidation process. The main idea of this technique was based on the oxidation of aromatic sulfur compounds to their more polar oxidized forms, followed by concentrating the more polar compounds into a polar solvent.

SUMMARY OF THE INVENTION

In this invention, ferrate is used to oxidize sulfur compounds to their corresponding oxidized from. The sulfur compounds known in the fuels are as shown in FIG. 1.

What is shown and described, according to the disclosed inventive principles, sulfur containing compounds are oxidized using ferrate, by means of an intermediary solvent.

Ferrate compounds and liquid ferrate, as may be used in the practice of this invention, and according to the disclosed inventive principles are selected from the group consisting of, a) $Na_2FeO_3$;
b) $Na_4FeO_4$;
c) $Na_3FeO_4$;
d) $Na_2FeO_4$.
e) $NaFeO_2$;
f) $Na_2FeO_2$.

As shown for a preferred embodiment and for a best mode, and by way of example for the ferrate compounds consisting of the group a) to f), listed above, sulfur containing compounds are oxidized using ferrate by means of an intermediary solvent.

As shown for a best mode and according to a preferred embodiment, the oxidation by ferrate is presented by equations as shown in FIG. 2.

The resulting sulfur compounds than can be removed by absorption, for example by use of silica as an adsorbing agent. As shown by the disclosed inventive principles, a sulfur containing compound is dissolved in an intermediary in phosphate/acetonitrile. The pH of the solution is adjusted at the desired pH (3.0-10.0) by adding, for example phosphoric acid or sodium hydroxide.

In solution, the ferrate liquid solution was added and reaction was allowed to complete.

The resulting oxidized compounds, as shown in FIG. 2, are extracted by means of an agent which adsorbs the oxidized compounds which are then removed from the reaction medium.

As shown, the oxidized sulfur may be removed by the addition of silica or polar solid support, agent leaving clean fuel.

What is shown and disclosed according to the disclosed inventive principles as shown in a preferred embodiment is a method for desulfurization of heavy fuel oil using ferrate compounds comprising the steps of, mixing fuel oil containing sulfur compounds with a solvent and forming a fuel oil solvent mixture; dissolving the sulfur compounds present said fuel oil solvent mixture; adding a liquid ferrate solution to the fuel oil solvent mixture, producing oxidized sulfur compounds in solution, and adding an absorbing agent to remove the oxidized sulfur compounds from the solution.

Additionally disclosed is said step of mixing fuel oil containing sulfur compounds with a solvent, includes the step of selecting said solvent from the group of organic solvents having similar polarity or dielectric constants, as acetonitrile.

Additionally disclosed is the said step of mixing fuel oil containing sulfur compounds with a solvent, includes the step of selecting the solvent phosphate/acetonitrile (50%, v/v).

Additionally disclosed is the said step of mixing fuel oil containing sulfur compounds with a solvent, includes the step of adjusting the pH of said fuel oil solvent mixture in a range of pH (2.0-12.0).

Additionally disclosed is the said step of adjusting the pH of said fuel oil solvent mixture includes the step of adding phosphoric acid or sodium hydroxide to said solution.

Additionally disclosed is said step of adding a liquid ferrate solution to said fuel oil-solvent mixture, includes the step preparing said liquid ferrate solution by dissolving solid potassium ferrate salt into borate/phosphate solution.

Additionally disclosed is the said step of adding a liquid ferrate solution to said fuel oil-solvent mixture, for reaction with said fuel oil-solvent mixture and allowing said reaction to complete.

Additionally disclosed is the said step of adding a liquid ferrate solution to said fuel oil-solvent mixture, and producing oxidized fuel oil compounds, in solution includes the step of, adding said ferrate solution to said fuel oil-solvent mixture in a range of molar ratios of ferrate to said fuel oil-solvent mixture 1.0-11.0.

Additionally disclosed is the said step of adjusting the pH of said fuel oil solvent mixture in a range of pH (2.0-12.0), includes the step of adjusting the said pH of said solution to a range of between 7.0-9.0 and in a range of temperature of 15 to 80° C.

Additionally disclosed is the step of adding a liquid ferrate solution to said fuel oil solvent mixture, producing oxidized sulfur compounds, in solution includes the step of includes the step of dissolving solid ferrate salt in a buffer solution.

Additionally disclosed is the aid step of dissolving solid ferrate salt in buffer solution, includes the step of dissolving said solid ferrate salt in borate/phosphate buffer solution.

Additionally disclosed is said step of adding an absorbing agent includes the step of adding silica or polar solid support.

Additionally disclosed is the step of adding a liquid ferrate includes the step of adding a liquid ferrate solution.

Additionally disclosed is the step of adding a liquid ferrate includes the step of adding a liquid ferrate from the group consisting of, a) $Na_2FeO_3$;
b) $Na_4FeO_4$;
c) $Na_3FeO_4$;
d) $Na_2Fe_4$;
e) $NaFeO_2$;
f) $Na_2FeO_2$.

Additionally disclosed is the step of adding a liquid ferrate solution to said fuel oil solvent mixture, in solution, includes the step of dissolving a solid ferrate salt selected from the group consisting of a) $Na_2FeO_3$;
b) $Na_4FeO_4$;
c) $Na_3FeO_4$;
d) $Na_2FeO_4$;
e) $NaFeO_2$;
f) $Na_2FeO_2$, in a buffer solution.

DETAILED DESCRIPTION OF THE INVENTION

As shown and described, according to the disclosed inventive principles, sulfur containing compounds are oxidized using ferrate, by means of an intermediary solvent.

Ferrate compounds and liquid ferrate, as may be used in the practice of this invention, and according to the disclosed inventive principles are selected from the group consisting of, a) $Na_2FeO_3$;
b) $Na_4FeO_4$;
c) $Na_3FeO_4$;
d) $Na_2FeO_4$.
e) $NaFeO_2$;
f) $Na_2FeO_2$.

As shown for a preferred embodiment and for a best mode, and by way of example for the ferrate compounds consisting of the group a) to f), listed above, sulfur containing compounds are oxidized using ferrate by means of an intermediary solvent.

Figure 1:
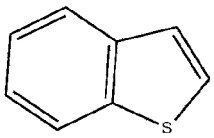
FIG. 1. shows in chemical notation, poly aromatic sulfur containing compounds present in fossil fuels.
Figure 1:
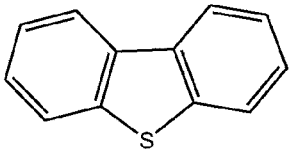
Figure 1:
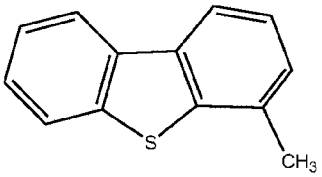
Figure 1:
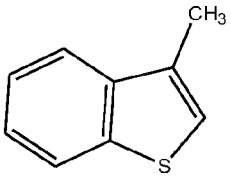
Figure 1:
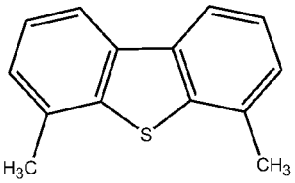
Figure 1:
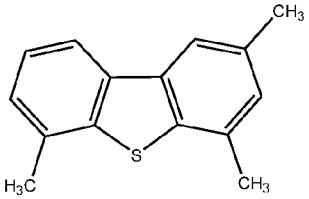
Figure 2:
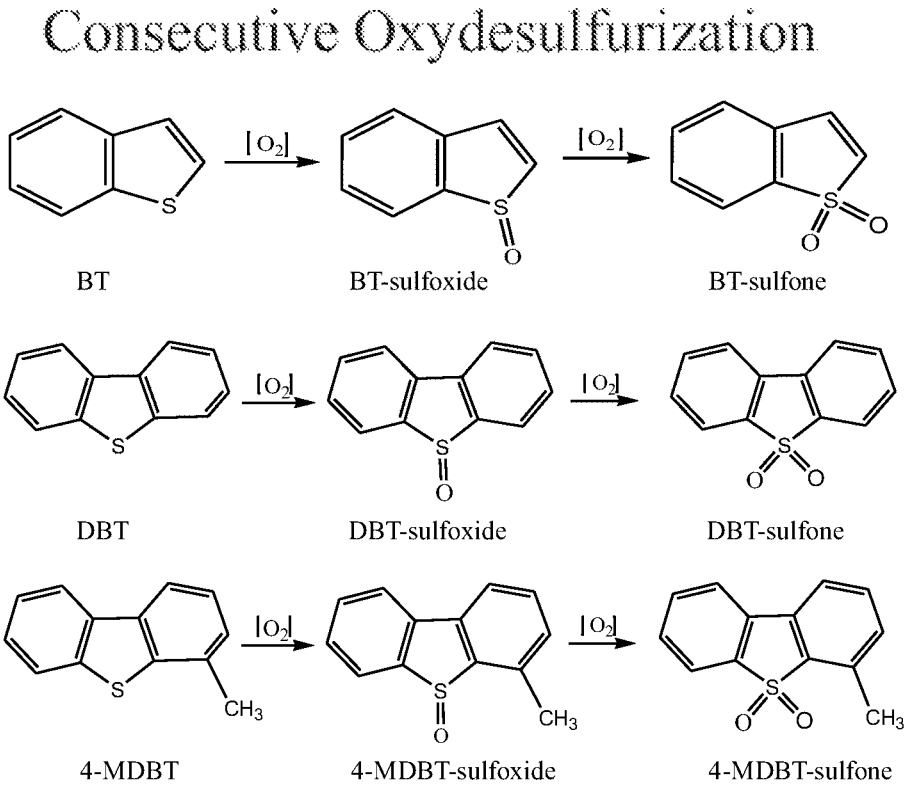
FIG. 2. shows in chemical notation, the oxidation of organic sulfur containing compounds in fossil fuels by ferrate.

As shown for a best mode and according to a preferred embodiment, the oxidation by ferrate presented by equations as shown in FIG. 2.

The resulting sulfur compounds than can be removed by absorption, for example by use of silica as an adsorbing agent. As shown by the disclosed inventive principles, a sulfur containing compound is dissolved in an intermediary in phosphate/acetonitrile. The pH of the solution is adjusted at the desired pH (3.0-10.0) by adding, for example phosphoric acid or sodium hydroxide.

In solution, the ferrate liquid solution was added and reaction was allowed to complete.

The resulting oxidized compounds, as shown in FIG. 2, are extracted by means of an agent which absorbs the oxidized compounds which are then removed from the reaction medium. As shown for a preferred embodiment and according to the inventive principles, the oxidized sulfur may be removed by the addition of silica or polar solid support, agent leaving clean fuel.

As shown for a preferred embodiment and according to the inventive principles, sulfur compounds, benzothiophene, dibenzothiophene, and 4-methyl dibenzothiophene, present in fuel are dissolved in phosphate/acetonitrile (50%, v/v). This ratio can be varied from 30/70-70/30%. This solvent system is used in the disclosed process shown in a preferred embodiment and for a best mode. Other suitable organic solvents having similar polarity (or dielectric constants) as acetonitrile may also be used as would be known to those skilled in the art. The acetonitrile may be recycled as would be known to those skilled in the art.

The pH of the solutions can be adjusted at the desired pH (3.0-10.0) by adding either phosphoric acid or sodium hydroxide, for example. The adjustment of pH can be varied from pH 2.0-12.0.

As shown, by the disclosed inventive principles, a liquid ferrate solution is added and reaction produced by the addition of the liquid ferrate is allowed to complete. Completion of the reaction is indicated, for example, where the color of liquid ferrate solution was eliminated.

A liquid ferrate solution may be prepared, by any suitable method known to those skilled in the art and for example, by dissolving solid potassium ferrate selected from the group a) to f) listed above, into a buffer solution, for example a borate/phosphate solution. Another suitable method for preparing liquid ferrate may be as shown in U.S. Patent Publication US 2011-0076223 A1.

The molar ratios of ferrate to model compound may be varied from 1.0-11.0. The removal of sulfur compound may be produced through a variation of pH and temperature. In a preferred embodiment and for a best mode, complete removal of sulfur compound was obtained at pH between 7.0-9.0 at room temperature (22±3° C.). The temperature can be varied from 15-80° C.

The concentration of model compounds may be analyzed, as would be known to those skilled in the art, to establish the molar ratio when complete oxidation of the model compound to its oxidized form was achieved. The inventive process is shown schematically, in accordance with the disclosed inventive principles, in FIG. 3.

The acetonitrile used in the process may be recycled.

Figure 3:
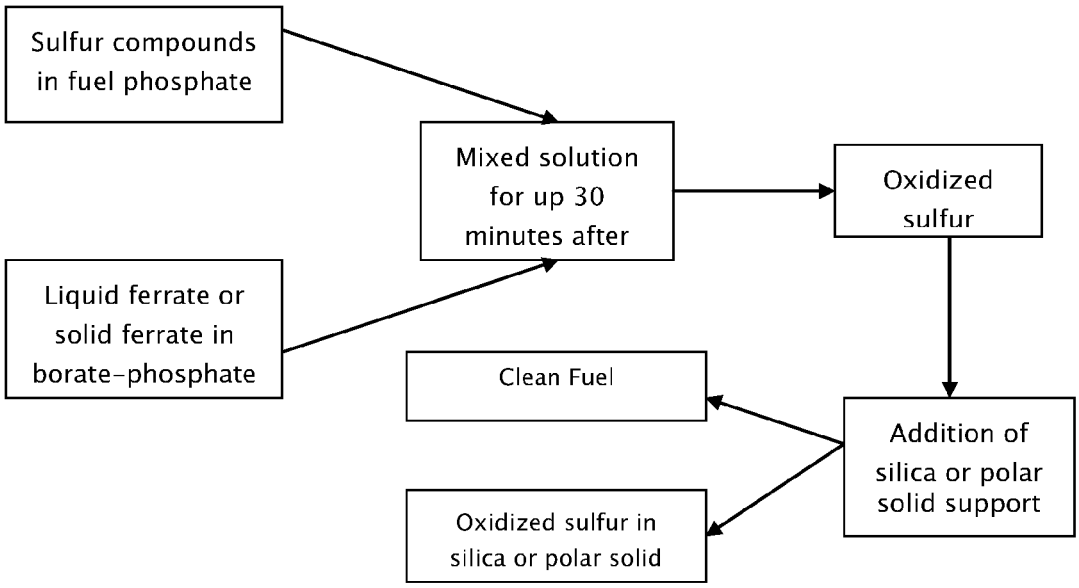
FIG. 3. shows in a block diagram, the inventive process for desulfurization of fossil fuels by use of an intermediate solvent appropriate for heavy oil

The inventive process is as shown in FIG. 3 and as disclosed in a preferred embodiment according to the disclosed inventive principles. As shown, Sulfur compounds in fuel phosphate are mixed with liquid ferrate or solid ferrate in a buffer solution, for example borate phosphate. The mixture of is allowed to react wherein the oxidized sulfur and clean fuel is produced. The oxidized sulfur may be removed using silica or polar support.

As would be understood by those skilled in the art, the disclosed invention is as would be understood by those skilled in the art and is not to be limited by the disclosed preferred embodiment or the example shown.

The invention claimed is:

1. A method for Desulfurization of Heavy Fuel Oil Using Ferrate comprising the steps of, mixing fuel oil containing sulfur compounds with a solvent and forming a fuel oil solvent mixture;

adjusting the pH of said fuel oil solvent mixture in a range of pH 8.0-10.0);

dissolving said sulfur compounds present in said fuel oil solvent mixture;

adding a liquid ferrate solution which does not comprise Mn(III) acetate to said fuel oil solvent mixture, producing oxidized sulfur compounds in solution; and adding silica as a catalyst and an adsorbing agent to remove said oxidized sulfur compounds from said solution.

2. The method of claim 1, wherein, said step of mixing fuel oil containing sulfur compounds with a solvent, includes the step of selecting said solvent from the group of organic solvents having the same polarity or dielectric constant as acetonitrile.

3. The method of claim 2, wherein said step of mixing fuel oil containing sulfur compounds with a solvent includes the step of selecting the solvent phosphate/acetonitrile (50%, v/v); and wherein the method of claim 2 further comprises the step of recycling said acetonitrile.

4. The method of claim 3, wherein said step of adjusting the pH of said fuel oil solvent mixture includes the step of adding phosphoric acid or sodium hydroxide to said solution.

5. The method of claim 1, wherein said step of adding a liquid ferrate solution to said fuel oil-solvent mixture, includes the step preparing said liquid ferrate solution by dissolving solid potassium ferrate into borate/phosphate solution.

6. The method of claim 1, wherein said step of adding a liquid ferrate solution to said fuel oil-solvent mixture, for reaction with said fuel oil-solvent mixture and allowing said reaction to complete.

7. The method of claim 1, wherein said step of adding a liquid ferrate solution to said fuel oil-solvent mixture, and producing oxidized fuel oil compounds, in solution includes the step of, adding said ferrate solution to said fuel oil-solvent mixture in a range of molar ratios of ferrate to said fuel oil-solvent mixture 1.0-11.0.

8. The method of claim 1, wherein, said step of adjusting the pH of said fuel oil solvent mixture in a range of pH 8.0-10.0, includes the step of adjusting the said pH of said solution to a range of between 8.0-9.0 and in a range of temperature of 15 to 80° C.

9. The method of claim 1, wherein said step of adding a liquid ferrate solution to said fuel oil solvent mixture, producing oxidized sulfur compounds, in solution includes the step of dissolving solid ferrate salt in a buffer solution.

10. The method of claim 9, wherein the step of dissolving solid ferrate salt in a buffer solution, includes the step of dissolving said solid ferrate in borate/phosphate buffer solution.

11. The method of claim 1 wherein the step of adding a liquid ferrate solution to said fuel oil solvent mixture, producing oxidized sulfur compounds, in solution, includes the step of adding a liquid ferrate from the group consisting of, a) $Na_2FeO_3$;
b) $Na_4FeO_4$;
c) $Na_3FeO_4$;
d) $Na_2FeO_4$;
e) $NaFeO_2$;
f) $Na_2FeO_2$.

12. The method of claim 1, wherein said step of adding a liquid ferrate solution to said fuel oil solvent mixture, producing oxidized sulfur compounds, in solution includes the step of dissolving solid ferrate salt selected from the group consisting of a) $Na_2FeO_3$;
b) $Na_4FeO_4$;
c) $Na_3FeO_4$;
d) $Na_2FeO_4$;
e) $NaFeO_2$;
f) $Na_2FeO_2$, in a buffer solution.

* * * * *